United States Patent [19]

Saito

[11] Patent Number: 4,543,508

[45] Date of Patent: Sep. 24, 1985

[54] CATHODE RAY TUBE WITH AN ELECTRON LENS FOR DEFLECTION AMPLIFICATION

[75] Inventor: Kimiharu Saito, Hino, Japan

[73] Assignee: Iwatsu Electric Co., Ltd., Tokyo, Japan

[21] Appl. No.: 591,515

[22] Filed: Mar. 20, 1984

[30] Foreign Application Priority Data

Apr. 12, 1983 [JP] Japan ..... 58-64244
Jul. 20, 1983 [JP] Japan ..... 58-132289

[51] Int. Cl.[4] ..... H01J 29/70; H01J 29/46

[52] U.S. Cl. ..... 313/429; 313/432; 313/449; 313/460; 315/15; 315/17

[58] Field of Search ..... 313/426, 429, 432, 436, 313/444, 449, 460; 315/15, 17, 376

[56] References Cited

U.S. PATENT DOCUMENTS 3,496,406 2/1970 Deschamps ..... 313/429 X
4,142,128 2/1979 Odenthal ..... 315/15
4,302,704 11/1981 Saito ..... 315/17

*Primary Examiner*—Palmer C. DeMeo
*Assistant Examiner*—K. Wieder
*Attorney, Agent, or Firm*—Woodcock, Washburn, Kurtz, Mackiewicz & Norris

[57] ABSTRACT

A generally box shaped, electronic lens system is incorporated in a cathode ray tube for amplification of both horizontal and vertical deflections of the electron beam. The lens system comprises two electrodes, one partly nested in the other with an insulating gap therebetween and both so disposed as to encompass the trajectories of the beam from the deflection system to the target of the CRT. A postaccelerating or other postdeflection electrode is provided to exert its field upon at least the target side end of the lens system. Upon application of prescribed potentials to the two lens electrodes and to the postdeflection electrode, the lens system provides a quadrupolar lens therein for deflection amplification in both directions. The lens system further coacts with the postdeflection electrode to create another electron lens adjacent its beam exit end for converging the beam in one of the orthogonal directions of beam deflection.

14 Claims, 40 Drawing Figures

CATHODE RAY TUBE WITH AN ELECTRON LENS FOR DEFLECTION AMPLIFICATION

BACKGROUND OF THE INVENTION

This invention relates to cathode ray tubes (CRTs) for use in oscilloscopes, storage oscilloscopes, etc., and more specifically to a CRT having a novel electron lens system of two electrode configuration for amplifying the deflections of the electron beam, which dispenses with the familiar mesh that has been employed to obtain good display characteristics.

The postdeflection acceleration or postacceleration CRT has been known which employs a planar or domed mesh and a postaccelerating electrode on the inside surface of the bulb or envelope for creating an accelerating field designed to increase the velocity of the beam electrons after they have traversed the deflection fields. Thus postaccelerated, the beam provides a spot of increased brilliance on the fluorescent screen. The mesh incorporated in this known type of CRTs, however, causes a decrease in electron gun efficiency, a defocusing of the beam spot on the screen, and halation due to secondary emission from the mesh. Recent efforts in the electronics industry have therefore been directed toward the development of meshless CRTs.

U.S. Pat. No. 4,142,128 to Odenthal reflects an example of such conventional efforts. This patent proposes a box shaped, four element electronic lens for use in both monoaccelerator and postacceleration CRTs. The electronic lens, commonly referred to as a scan expansion lens or deflection amplification lens, defeats many of the limitations of the more conventional meshes. For truly satisfactory display characteristics, however, the lens must measure 10.6 by 6.3 by 2.5 centimeters to provide an eight by 10 centimeter display. This size is far greater than that of the dome mesh, making Odental's lens unusable with the glass envelope of the standard CRT size. Another drawback of the known lens appears in its application to postacceleration CRTs. The exit end electrode of the lens must be electrically connected to the CRT screen in this application, with the consequent difficulties in giving the required voltage withstanding abilities to the lens electrodes.

These drawbacks are absent from the three element lens system described and claimed in U.S. Pat. No. 4,302,704 filed by the instant applicant. Intended for use in postacceleration CRTs, the lens system has three tubular or box-like electrodes disposed in axial alignment and electrically insulated from one another. The target side electrode has an end plate which closes its beam exit end and which has an elongate aperture formed therein. The lens system gives the beam a divergent action in one of the orthogonal directions of beam deflection and a doubly convergent action in the other, making it possible to provide a spot that suffers little or no defocusing in the vertical direction.

However, the applicant's prior lens system has proved to have certain inconveniences. One of these is that the intermediate electrode of the lens system has its two pairs of sides convexed and concaved toward both gun and target, with the two outer electrodes being shaped correspondingly to provide insulating gaps of constant width (approximately one millimeter) therebetween. This configuration requires the individual electrodes to be manufactured to very stringent dimensional tolerances for the provision of a lens system of desired performance characteristics. Another is the need for the provision of a shielding electrode to prevent the intrusion of the postaccelerating field into the lens system through the insulating gaps.

SUMMARY OF THE INVENTION

The present invention overcomes the limitations of the noted CRTs incorporating scan expansion lenses and provides, in particular, an improved scan expansion lens system which is far simpler in configuration and easier of manufacture than its predecessors but which is no less favorable in performance characteristics.

According to the invention, stated in brief, there is provided apparatus including a cathode ray tube having an electron gun for producing a beam of electrons directed toward a target, deflection means for deflecting the beam in two orthogonal directions (i.e. vertical and horizontal), and a postdeflection electrode (e.g. postaccelerating electrode or collimation electrode) adjacent the target. Also included is a scan expansion lens system lying between deflection means and target, in such a position that at least the target side or beam exit end of the lens system is acted upon by the field of the postdeflection electrode.

Characteristically the lens system comprises first and second tubular, open ended electrodes of substantially rectangular cross sectional shape disposed in axial alignment to allow the passage of the beam therethrough. The second electrode surrounds at least the beam exit end portion of the first electrode with an electrically insulating gap therebetween. Each lens electrode has a first pair of opposite sides oriented in one of the orthogonal directions of beam deflection, and a second pair of opposite sides oriented in the other of the orthogonal directions. Let it be assumed, to facilitate understanding, that the first pair of opposite sides of each lens electrode are disposed horizontally and therefore are top and bottom sides. Then the second pair of opposite sides can be thought of as right and left sides.

The first electrode, nested in the second electrode and partly projecting therefrom toward the electron gun, has the beam exit ends of its first pair of opposite sides each curved in an arc that is convex in a first direction (i.e. toward the electron gun or toward the target). The beam exit ends of the second pair of opposite sides of the first electrode are each curved in an arc that is convex in a second direction opposite to the first direction.

Thus, upon application of prescribed electrical potentials to the two electrodes of the lens system and to the postdeflection electrode, the lens system provides a first electron lens, created by its two constituent electrodes, for amplifying beam deflection in one of the orthogonal directions (e.g. vertical) by altering or inverting (with respect to the axis of the CRT) the traveling direction of the beam that has been deflected in that direction and also for amplifying the deflection of the beam that has been deflected in the other of the orthogonal directions (e.g. horizontal). The second electrode of the lens system further coacts with the postdeflection electrode to create a second electron lens for converging the beam that has been deflected in that one of the orthogonal directions.

The linearity of the deflection factor in one of the orthogonal directions would be rather poor if beam deflection in that direction were magnified solely by the first, quadrupolar lens created by the two electrodes of the lens system. However, the deflection factor linearity can actually be materially improved by virtue of the second, convergent lens which results from the intrusion of the intense field of the postdeflection electrode into the beam exit end of the second lens electrode. Thus, despite its greatly simplified configuration, the lens system makes possible the provision of a CRT having a good linearity of the deflection factor in either direction.

No less pronounced feature of the lens system in accordance with the invention is that the first lens electrode has at least its beam exit end portion received in the second lens electrode. This arrangement eliminates the need for the provision of any external means whatever for shielding the gap between the two lens electrodes from the field of the postdeflection electrode. This advantage, combined with the simplified construction and ease of manufacture of the lens system itself, significantly reduces the cost of the CRT of the type in question.

The above and other features and advantages of the present invention and the manner of realizing them will become more apparent, and the invention itself will best be understood, from a study of the following description and appended claims, with reference had to the attached drawings showing some preferable embodiments of the invention.

DESCRIPTION OF THE PREFERRED EMBODIMENTS

General

Figure 1:
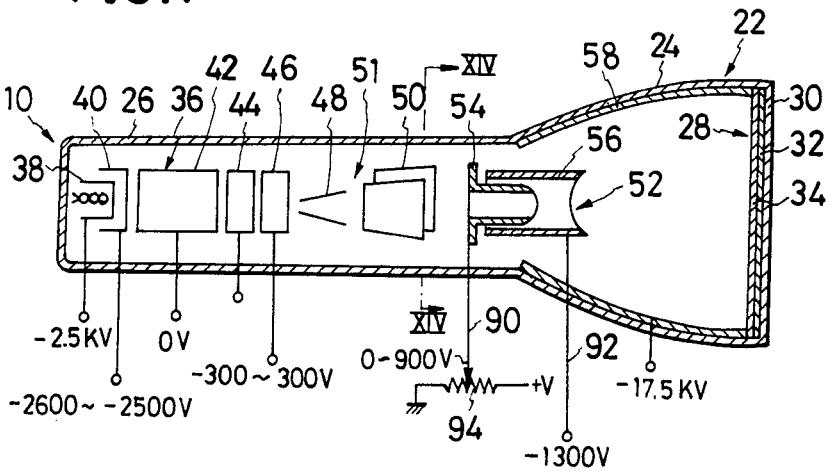
FIG. 1 is a longitudinal section through the CRT constructed in accordance with the novel concepts of this invention, the CRT including a preferred form of the scan expansion lens system constituting a feature of the invention.
Figure 2:
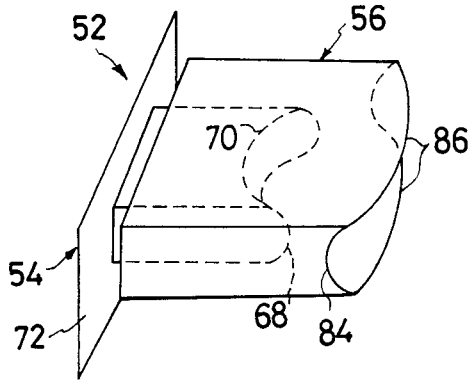
FIG. 2 is an enlarged perspective view of the lens system employed in the CRT of FIG. 1.
Figure 3:
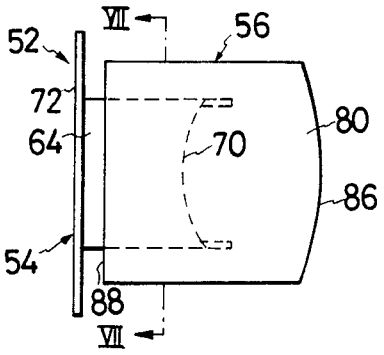
FIG. 3 is a plan view of the lens system.
Figure 5:
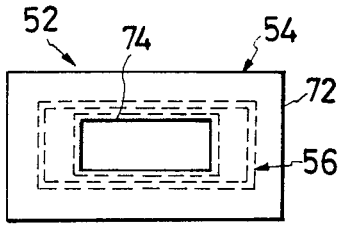
FIG. 5 is an elevation of the lens system as seen from the left hand side of FIG. 4.
Figure 6:
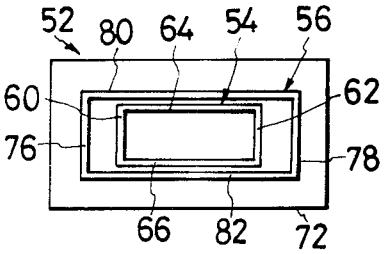
FIG. 6 is also an elevation of the lens system as seen from the right hand side of FIG. 4.
Figure 4:
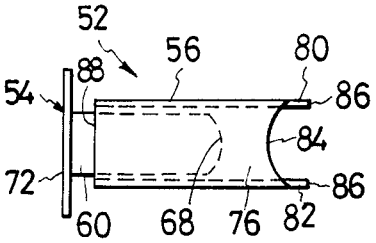
FIG. 4 is a side elevation of the lens system.
Figure 7:
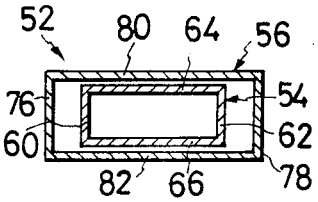
FIG. 7 is a cross section through the lens system, taken along the line VII—VII of FIG. 3.
Figure 8:
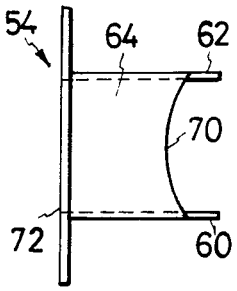
FIG. 8 is a plan view of the first or inner electrode of the lens system.
Figure 9:
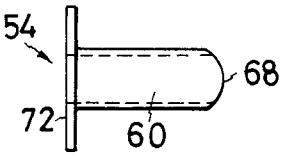
FIG. 9 is a side elevation of the inner electrode of FIG. 8.

The present invention is will now be described in detail as embodied, first of all, in a post acceleration CRT for oscilloscopic applications shown in FIG. 1. Generally designated 10, the exemplified CRT has an evacuated envelope 22 of glass or other suitable insulating material. The envelope 22 comprises a funnel portion 24 and neck portion 26 of one piece construction. The funnel portion 24 has a target 28 on its front end, directed to the right in FIG. 1. The target 28 is shown as a fluorescent screen comprising a faceplate 30, a phosphor layer 32 behind the faceplate, and a conductive layer 34 further behind the phosphor layer.

The neck portion 26 of the vacuum envelope 22 has an electron gun 36 mounted adjacent its end away from the target 28. The electron gun 36 conventionally comprises a cathode 38, a first grid 40, a second grid 42, a first anode 44, and a second anode 46. Arranged axially of the envelope neck portion 26, the electron gun 36 generates and emits a beam of electrons directed toward the target 28.

On its way from electron gun 36 to target 28 the electron beam passes a pair of vertical deflection plates 48 and then a pair of horizontal deflection plates 50. The vertical deflection plate pair 48 and horizontal deflection plate pair 50, constituting in combination a deflection system 51, deflect the electron beam vertically and horizontally, respectively, in the manner familiar to the specialists. The adjectives "vertical" and "horizontal" as used above are conventional and do not necessarily imply that the beam is deflected vertically and horizontally in the exact senses of the words. All that is required, of course, is that the two deflection plate pairs deflect the beam in orthogonal directions.

Arranged next to the horizontal deflection plate pair 50 is a generally box shaped, two element, electronic scan expansion lens system 52 constituting a feature of the present invention. The lens system 52 comprises first 54 and second 56 tubular electrodes, each approximately in the shape of an open ended box, which are nested with respect to each other but electrically insulated from each other. This lens system functions to amplify the vertical and horizontal deflections of the electron beam so as to provide full coverage of the target 28, as will be detailed presently both as to its configuration and operation.

The CRT 10 further comprises a postdeflection electrode 58, herein shown as an accelerating electrode in the form of a conductive layer coated on the inside surface of the envelope funnel portion 24 in electrically conducting relation with the conductive layer 34 of the target 28. The postaccelerating electrode 58 thoroughly encompasses the path of the electron beam from scan expansion lens system 52 to target 28. The position of the lens system 52 in relation to that of the postaccelerating electrode 58 is such that the field of the electrode 58 acts at least upon the target side or beam exit end of the second electrode 56 of the lens system. This positional relationship between lens system 52 and postaccelerating electrode 58 is essential for the proper performance of the lens system, as will become apparent as the description proceeds.

The target 28, electron gun 36, deflection system 51, and postaccelerating electrode 58 of the exemplified CRT 10 can each be of standard design and, as a whole, of standard arrangement. No more detailed discussion of their constructions will therefore be necessary. The present invention particularly features the scan expansion lens system 52 and its structural and functional relations with the other components of the CRT.

Typical values of potentials that may be applied to the various electrodes of the CRT 10 for its operation are as follows: −2500 volts to the cathode 38 of the electron gun 36; from −2600 to −2500 volts to the electron gun first grid 40; 0 volts to the electron gun second grid 42; from −300 to +300 volts to the electron gun second anode 46; +900 volts to the first electrode 54 of the scan expansion lens system 52; −1300 volts to the scan expansion lens second electrode 56; and 17,500 volts to the postaccelerating electrode 58.

Configured as above, and with the appropriate poentials applied to its electrodes, the CRT 10 operates to produce a visible pattern of the input signal on the target 28. The first grid 40 of the electron gun 36 controls the emission of electrons from the cathode 38. The emitted electrons in a beam are accelerated by the second grid 42 and then focused by the unipotential lens comprised of the second grid 42 and the first 44 and second 46 anodes. The focused electron beam is then deflected vertically and horizontally by the deflection system 51 composed of the vertical deflection plate pair 48 and the horizonal deflection plate pair 50. Then the scan expansion lens system 52 in accordance with the invention amplifies the vertical and horizontal deflections of the electron beam so as to enable same to cover the complete quality area of the target 28 in a manner detailed subsequently.

Scan Expansion Lens System

The scan expansion lens system 52 is shown in detail and on an enlarged scale in FIGS. 2 through 9. As has been mentioned, the scan expansion lens system 52 comprises the two nested, electrically insulated tubular or boxlike electrodes or lens elements 54 and 56. The two electrodes are axially aligned about the axis of the vacuum envelope 22.

The first or inner electrode 54, lying somewhat closer to the electron gun 36 than the second or outer electrode 56, has a first, shorter pair of opposite sides 60 and 62 disposed in one of the orthogonal directions of beam deflection, namely, vertically, and a second, longer pair of opposite sides 64 and 66 disposed in the other direction of beam deflection, namely, horizontally. The first pair of opposite sides 60 and 62 and the second pair of opposite sides 64 and 66 are each of the same shape and size. The beam exit ends 68, directed toward the target 28, of the first pair of opposite sides 60 and 62 are each curved in an arc of a constant or varying radius that is convex in a first direction, that is, toward the target 28. The beam exit ends 70 of the second pair of opposite sides 64 and 66 are each curved in an arc of a constant or varying radius that is convex in a second direction opposite to the first direction, that is, toward the electron gun 36. The beam entrance ends 74 of the four sides 60, 62, 64 and 66 are all straight and extend at right angles with the axis of the vacuum envelope 22.

Also forming a part of the inner electrode 54 is a rectangular flange 72 at its beam entrance end 74. Oriented at right angles with the axis of the vacuum envelope 22, the flange 72 serves the purpose of shielding the outer electrode 56 from the effects of the horizontal deflection plate pair 50.

The outer electrode 56 likewise comprises a first, shorter pair of opposite sides 76 and 78 disposed in one of the orthogonal directions of beam deflection, and a second, longer pair of opposite sides 80 and 82 disposed in the other direction of beam deflection. The first pair of opposite sides 76 and 78 and the second pair of opposite sides 80 and 82 are each of the same shape and size. The beam exit ends 84 of the first pair of opposite sides 76 and 78 are each curved in an arc of a constant or varying radius that is convex toward the electron gun 36. The beam exit ends 86 of the second pair of opposite sides 80 and 82 are each curved in an arc of a constant or varying radius that is convex toward the target 28. The gun side ends 88 of the four sides 76, 78, 80 and 82 are all straight and extend at right angles with the axis of the vacuum envelope 22.

The inner electrode 54 is shown mostly nested with clearance in the outer electrode 56, only with the beam entrance end portion of the inner electrode exposed. It is essential that the outer electrode 56 loosely enclose at least the beam exit end portion of the inner electrode 54.

The dimensions of the scan expansion lens system 52, for use in the CRT 10 having a screen size of eight by 10 centimeters, may be determined as follows. The inner electrode 54 has a vertical dimension of 10 millimeters and a horizontal dimension, in the direction at right angles with the bulb axis, of 24 millimeters. The dimension between the entrance ends 74 and the apexes of the concave ends 70 of the inner electrode 54 is 21 millimeters. The dimension between the beam entrance ends 74 and the apexes of the convex ends 68 of the inner electrode 54 is 24 millimeters. The convex ends 68 of the inner electrode 54 are each curved with a constant radius of six millimeters. The concave ends 70 of the inner electrode 54 are each curved with a constant radius of 20 millimeters. The outer electrode 56 has a vertical dimension of 14 millimeters and a horizontal dimension of 36 millimeters. The dimension between the gun side ends 88 and the apexes of the concave ends 84 of the outer electrode 56 is 26 millimeters. The dimension between the gun side ends 88 and the apexes of the convex ends 86 of the outer electrode 56 is 33 millimeters. The concave ends 84 of the outer electrode 56 are each curved with a constant radius of 10 millimeters. The convex ends 86 of the outer electrode 56 are each curved with a constant radius of 46 millimeters. The gaps between the first pair of opposite sides 60 and 62 of the inner electrode 54 and the first pair of opposite sides 76 and 78 of the outer electrode 56 are each 5.5 millimeters in width. The gaps between the second pair of opposite sides 64 and 66 of the inner electrode 54 and the second pair of opposite sides 80 and 82 of the outer electrode 56 are each 1.5 millimeters in width.

The electrodes 54 and 56 of the scan expansion lens system 52 are both fabricated of 0.5 millimeter thick nonmagnetic stainless steel plates.

With reference back to FIG. 1 the scan expansion lens system 52 is mounted within the vacuum envelope 22 in fixed relation to the electron gun 36 and deflection system 51. The electrodes 54 and 56 of the lens system are both provided with leads 90 and 92, respectively, for the application of operating potentials. The lead 90 of the inner electrode 54 is connected to a potentiometer 94 for adjustably varying the potential applied thereto.

Operation

In the operation of the CRT 10 a 900 volt potential (3400 volts with respect to the electron gun cathode potential) may be applied to the inner electrode 54 of the scan expansion lens system 52, and a −1300 volt potential (+1200 volts with respect to the cathode potential) to the outer lens electrode 56. The postaccelerating electrode 58, which bears particular pertinence to the operation of the scan expansion lens system 52, has a potential of 17,500 volts as aforesaid. The potentials applied to the other electrodes of the CRT 10 have also been set forth already and are indicated in FIG. 1.

Figure 10:
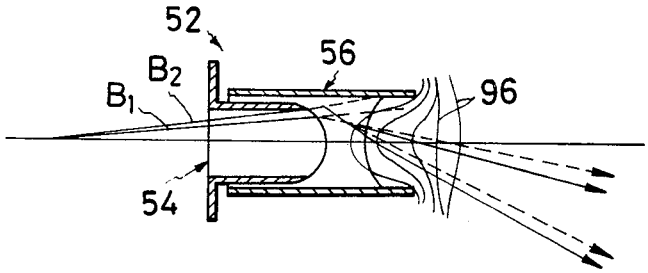
FIG. 10 is a schematic illustration of the deflection amplifying action of the lens system in a vertical direction.
Figure 11:
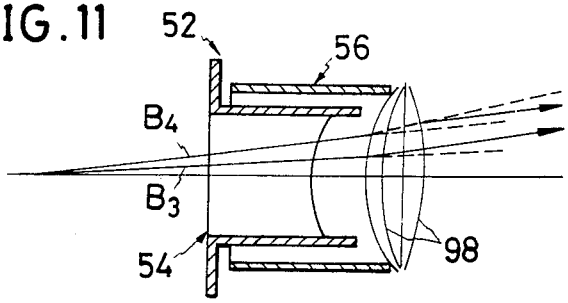
FIG. 11 is a similar illustration of the deflection amplifying action of the lens system in a horizontal direction.

FIG. 10 depicts the consequent action of the scan expansion lens system 52 in the vertical direction, and FIG. 11 the lens action in the horizontal direction. In FIG. 10 the reference characters B1 and B2 designate the electron beams that have been deflected to different degrees in the vertical direction by the vertical deflection plate pair 48. Within the lens system 52 the beams B1 and B2 do not follow the phantom straight line paths but trace the solid line trajectories as they change the directions of their travel owing to the convergent action of the quadrupolar lens composed of the two nested lens electrodes 54 and 56. Then the beams B1 and B2 undergo another convergent lens action at or adjacent the target side end of the outer lens electrode 56. After having been thus deflection magnified in the vertical direction, the beams strike the target 28.

The noted quadrupolar lens created internally of the lens system 52 will hereinafter be referred to as the internal lens, and the other lens created adjacent the exit end of the outer lens electrode 56 as the exit lens.

In FIG. 11 the characters B3 and B4 denote the electron beams that have been deflected to different degrees in the horizontal direction by the horizontal deflection plate pair 50. The beams B3 and B4 also do not follow the phantom straight line paths but have their horizontal deflections amplified by the divergent action of the internal lens, as indicated by the solid lines, before bombarding the target 28. It will further be noted from FIG. 11 that the beam B4 that has been deflected to a greater extent has its deflection slightly compressed by the convergent action due to the exit lens. The other beam B3 that has been deflected to a smaller degree hardly undergoes convergence at the exit end of the lens system 52.

No satisfactory linearity of the vertical deflection factor would result if the vertical deflection of the beam were amplified solely by virtue of the convergent action of the quadrupolar internal lens constituted of the four sides of the inner lens electrode 54 and the four sides of the outer lens electrode 56. For, as far as the internal lens is concerned, the greater the angle of vertical deflection, the more is the beam deflection magnified. Thus the deflection factor will become greater with an increase in the angle of vertical deflection. Our invention eliminates this defect by the convergent exit lens created at and adjacent the exit end of the second lens electrode 56 owing to the field of the postaccelerating electrode 58. As indicated by equipotential lines 96 in FIG. 10, the field due to the postaccelerating electrode 58 intrudes into the outer lens electrode 56 to provide the convergent exit lens. It is this additional convergent lens that accounts for the improved linearity of the deflection factor in accordance with the invention.

It will have been seen, then, that the lens system 52 dually amplifies the vertical deflection of the electron beam, first by the internal lens which alters the direction of beam travel and then by the exit lens as represented by the equipotentials 96. Deflection amplification by the exit lens is subject to change depending upon the angle of beam incidence and on its position. The exit lens amplifies vertical deilection to a lesser degree with an increase in the deflection angle. Thus the lens system 52 improves the linearity of the vertical deflection factor.

The same holds true with the linearity of the deflection factor in the horizontal direction. The horizontal deflection factor due to the internal lens itself becomes greater with an increase in the deflection angle. However, as the exit lens is created as indicated by equipotentials 98 in FIG. 11, the beam B3 that has been deflected to a slight degree passes the exit lens without being hardly affected thereby whereas the beam B4 that has been deflected through a greater angle has its deflection contracted. The greater the angle of horizontal deflection, the greater is the degree of deflection contraction offered by the exit lens. Accordingly the lens system 52 improves the linearity of the horizontal deflection factor as well.

Figure 12:
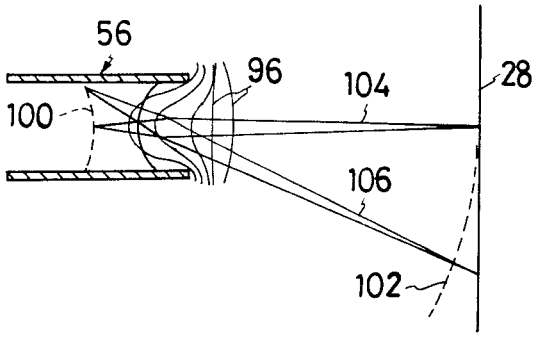
FIG. 12 is a similar illustration of the focusing action of the lens system in the vertical direction.

The exit lens of the lens system 52 serves the additional, but no less significant, purpose of sharply focusing the electron beam anywhere on the target or phospor screen 28. The illustrated lens system 52 changes, or reverses, the direction of the vertically deflected beam and is further designed to increase vertical deflection sensitivity. Consequently, as illustrated in FIG. 12, the distance from the first focal point 100 within the lens system 52 to the target 28 changes with the angle of vertical deflection. Were it not for the exit lens, the vertically deflected beam would focus on an arcuate line 102; that is, it would defocus on the target 28 to a progressively greater extent toward its top and bottom.

As will be seen also from FIG. 12, however, the exit lens of the lens system 52, as represented by the equipotentials 96 offers a variable convergent action to the beam depending upon its angle of incidence. The exit lens acts on both undeflected beam 104 and vertically deflected beam 106 so as to make them focus on the target 28. The focusing voltage required for the focusing of the vertically deflected beam 106 on the target 28 can be the same as that for focusing the undeflected beam 104 on the target.

Figure 13A:
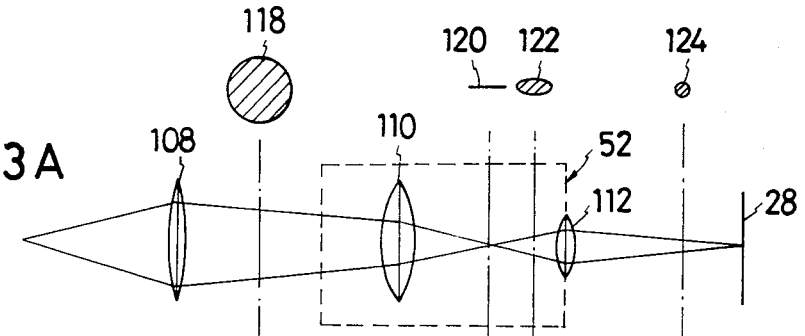
FIG. 13A illustrates by simplified optical analogy the vertical focusing action of the CRT of FIG. 1.
Figure 13B:
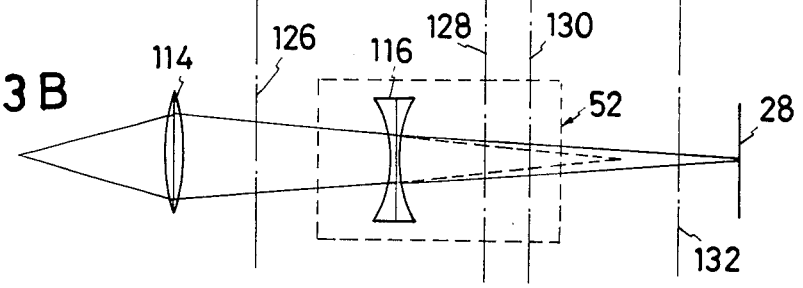
FIG. 13B illustrates by simplified optical analogy the horizontal focusing action of the CRT of FIG. 1.

FIG. 13A is an illustration of a simplified optical analogy to the just described vertical focusing action of the CRT 10 including the scan expansion lens system 52. FIG. 13B is a similar illustration of the horizontal focusing action of the CRT 10. A converging lens 108 seen in FIG. 13A is an optical equivalent to the combination of the second grid 42, first anode 44 and second anode 46 of the electron gun 36. FIG. 13A further shows the converging internal lens 110 formed by and within the lens system 52, and the converging exit lens 112 created at and adjacent the beam exit end of the outer lens electrode 56. Thus the lens system 52 substantially provides the two converging lenses 110 and 112 for the vertical focusing of the beam on the target 28.

A converging lens 114 in FIG. 13B is the same as the converging lens 108 of FIG. 13A. A diverging lens 116 is created internally of the lens system 52 for horizontally amplifying the deflections of the beam, as has been explained in connection with FIG. 11.

FIGS. 13A and 13B also indicate the cross sectional shapes 118, 120, 122 and 124 of the beam on planes 126, 128, 130 and 132, respectively, perpendicular to the axis of the vacuum envelope 22. These cross sectional beam shapes result from the above discussed vertical and horizontal focusing actions of the CRT 10.

Figure 14:
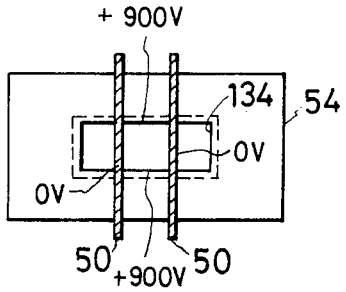
FIG. 14 is a cross section through the CRT, taken along the line XIV—XIV therein and showing the lens system and the pair of horizontal deflection plates which coact to correct image distortion on the target screen.

It is to be understood, however, that the showings of FIGS. 13A and 13B do not include additional optical lens means included in the CRT 10 for the correction of what is known as "pincushion distortion," in which all four sides of the screen display are concave. As has been stated with reference to FIGS. 2 through 9, the target side ends 68 and 70 of the inner lens electrode 54 and the target side ends 84 and 86 of the outer lens electrode 56 are concaved and convexed to reduce the pincushion distortion. It is, however, difficult or practically impossible to thoroughly eliminate this defect solely by virtue of the curvatures of the target side ends of the lens system electrodes 54 and 56. The present invention suggests, therefore, the curving of each target side end of the lens system electrodes 54 and 56 with a constant radius. The pincushion distortion that might appear as a consequence is corrected, instead, by the quadrupolar lens composed of the gun side end of the inner lens electrode 54 and the target side ends of the pair of horizontal deflection plates 50. The following study of FIG. 14 will make this corrective action more understandable.

The pair of horizontal deflection plates 50 each extend vertically whereas the beam entrance opening 134 of the inner lens electrode 54 is elongated horizontally. The combination of these horizontal deflection plates 50 and inner lens electrode opening 134 serves to impart "barrel distortion" to the beam in both vertical and horizontal directions. The barrel distortion is such that the image of a square appears barrel shaped. The intentional application of barrel distortion to the beam is effective to compensate for pincushion distortion, making possible the display of an undistorted image on the target screen. Altough the application of deflecting voltages introduces some distortion, this is negligible for all practical purposes.

There is another important consideration that must go into the design of the lens system 52. It is the fact that the shapes and sizes of the various parts of the lens system 52 affect its functional features. For example, the characteristics of the exit lens of the lens system 52 depends upon the radii of curvatures of the target side ends 84 and 86, and the vertical and horizontal dimensions, of the outer lens electrode 56. If the radius of curvature of the pair of opposite target side ends 86 of the outer lens electrode 56 is decreased from 46 millimeters, as in this embodiment, to, say 40 millimeters, the horizontal deflection sensivity of the complete system will increase, and the linearity of horizontal deflection factor will become expansive. Further, if the radius of curvature of the other pair of opposite target side ends 84 of the outer lens electrode 56 is increased from 10 millimeters, as in this embodiment, to, say, 20 millimeters, then the intense electric field due to the postaccelerating electrode 58 will intrude less into the opposite side portions of the outer lens electrode. This then will result in a decrease in horizontal sensitivity adjacent the opposite side ends of the target screen, and in a decrease in the horizontal linearity with an increase in the deflection angle.

Should the pair of opposite target side ends 86 of the outer lens electrode 56 be nearly straight, both horizontal sensitivity and the linearity of the deflection factor would deteriorate. It is therefore essential that these ends 86 of the outer lens electrode 56 be convexed toward tbe target 28 with an appropriate radius of curvature. Perhaps no less significant is the vertical dimension of the outer lens electrode 56, which can compensate for the nonuniformity of the vertical deflection factor of the internal lens of the lens system 52 by controlling the intrusion of the postaccelerating electrode field into the outer lens electrode in the vertical direction.

The curvatures of the two pairs of opposite target side ends 68 and 70 of the inner lens electrode 54 can also affect the image formation on the target screen. With a decrease in the radius of curvature of the pair of target side ends 68 of the inner electrode 54 from six millimeters to, say, 5.5 millimeters, the vertical image lines will suffer barrel distortion, and the horizontal image lines will suffer pincushion distortion. Also, with a decrease in the radius of curvature of the other pair of target side ends 70 of the inner lens electrode 54 from 20 millimeters to, say, 17 millimeters, the vertical image lines will suffer pincushion distortion, and the horizontal image lines will suffer barrel distortion. It is evident that the deflection factor becomes better with a decrease in the radius of curvature of either pair of ends 68 and 70 since then the internal lens of the lens system 52 is intensified.

From the foregoing considerations it will be seen that, in designing the CRT 10 in accordance with the teachings of the invention, the desired overall length, sensitivities, and quality screen area determine the dimensions of the inner lens electrode 54 and the radii of curvature of its two pairs of target side ends 68 and 70. These in turn determine the dimensions of the outer lens electrode 56 and the radii of curvature of its two pairs of target side ends 84 and 86. Even though the desired vertical and horizontal deflection sensitivities and linearity of the deflection factor may be fulfilled by the above design factors, some image distortion (mostly pincushion) may still persist. Such distortion is amendable by the aforesaid quadrupolar lens comprised of the gun side end portion of the first lens electrode 54 and the target side end portion of the horizontal deflection plate pair 50. The geometries and dimensions of the inner lens electrode 54 and those of the outer lens electrode 56 are interdependent.

The primary advantages accruing from the exemplified CRT 10 with its scan expansion lens system 52 may be summarized as follows:

1. The CRT offers great deflection amplification, the linearity of the deflection factor in both vertical and horizontal directions, the good focusing of the beam, and little or no image distortion, all despite the simplicity of its construction.

2. With the two electrodes 54 and 56 of the lens system 52 nested with respect to each other, the gap therebetween is shielded from the postaccelerating electrode 58. No extra means are necessary for this shielding purpose, contributing to the simplified construction of the CRT.

3. Correction of possible image distortion on the target screen is easily attained as the operating voltage of the inner lens electrode 54 is varied between, say, zero and 900 volts. The inner lens electrode will then coact as aforesaid with the horizontal deflection plate pair 50 to amend the distortion.

Second Form

Figure 15:
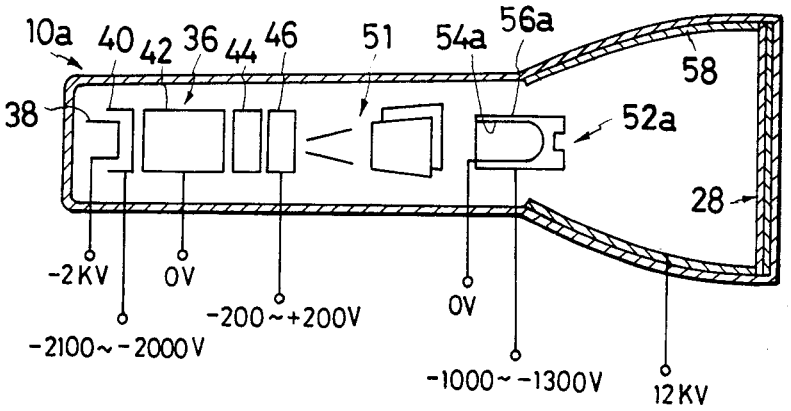
FIG. 15 is a longitudinal section through a CRT employing another preferable form of the scan expansion lens system in accordance with the invention.
Figure 16:
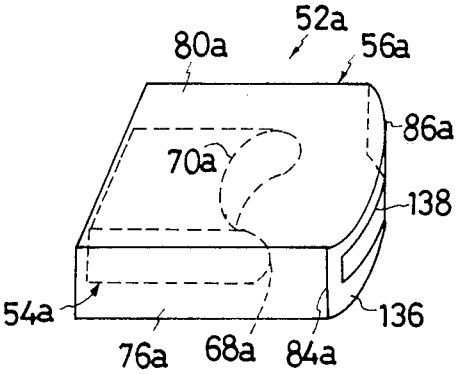
FIG. 16 is an enlarged perspective view of the lens system in the CRT of FIG. 15.
Figure 17:
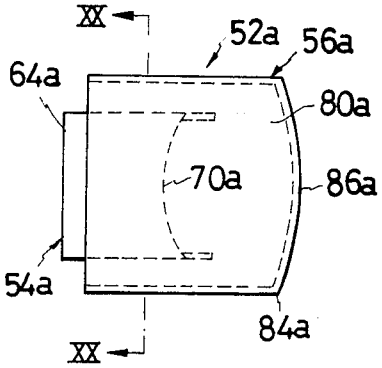
FIG. 17 is a plan view of the lens system of FIG. 16.
Figure 18:
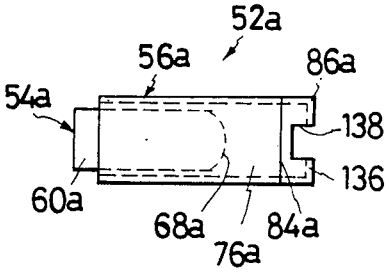
FIG. 18 is a side elevation of the lens system of FIG. 16.

FIG. 15 illustrates another preferred example of CRT 1O*a* in accordance with the invention, featuring a modified scan expansion lens system 52*a*. The other parts of the CRT 1O*a* are constructed and arranged just like their corresponding parts of the CRT 10, so that such parts will be identified, as necessary, by the same reference numerals as those used to denote the corresponding parts of the CRT 10, and their description will be omitted.

The modified lens system 52*a* is shown in detail in FIGS. 16 through 20. It comprises a first or inner electrode 54*a* and a second or outer electrode 56*a*, with the former mostly nested in the latter and having only its gun side end portion projecting therefrom. Of these the inner lens electrode 54*a* is analogous in construction with the inner lens electrode 54 of the lens system 52. Thus the inner lens electrode 54*a* has a first, shorter pair of opposite sides 60*a* and 62*a* and a second, longer pair of opposite sides 64*a* and 66*a*. The beam exit ends of the first pair of sides 60*a* and 62*a* are convexed at 68*a*, and the beam exit ends of the second pair of sides 64*a* and 66*a* are concaved at 70*a*.

Figure 19:
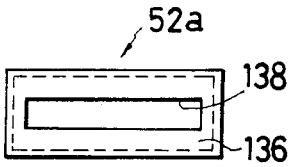
FIG. 19 is an elevation of the lens system as seen from the right hand side of FIG. 18.
Figure 20:
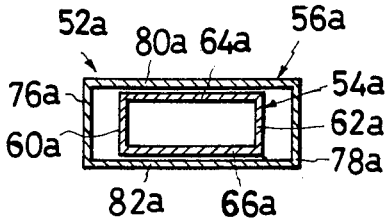
FIG. 20 is a cross section through the lens system, taken along the line XX—XX in FIG. 17.

The outer lens electrode 56*a* has a first, shorter pair of opposite sides 76*a* and 78*a* and a second, longer pair of opposite sides 80*a* and 82*a*. Tbe beam exit ends 84*a* of the first pair of sides 76*a* and 78*a* are straight whereas the beam exit ends 86*a* of the second pair of sides 80*a* and 82*a* are convexed. Further the outer lens electrode 56*a* is provided with a rectangular end plate 136 closing the beam exit end of the electrode and curved in conformity with the curvature of the beam exit ends 86*a* of its second pair of sides 80*a* and 82*a*. The end plate 136 has an elongate aperture or slot 138 formed centrally therein and extending parallel to the second pair of sides 80*a* and 82*a* of the outer lens electrode 56*a*, that is, horizontally. As best seen in FIG. 19, the aperture 138 of this particular embodiment is rectangular in shape, being bounded by two pairs of opposite, parallel sides.

Given below are the preferred dimensions of the modified scan expansion lens system 52*a* for use in the CRT 1O*a* whose screen size is eight by 10 centimeters. The inner lens electrode 54*a* has a vertical dimension of 10 millimeters and a horizontal dimension, as measured in a direction normal to the bulb axis, of 24 millimeters. The distance between the gun side end of each of the pair of opposite sides 64*a* and 66*a* and the apex of its concave target side end 70*a* is 21 millimeters. The distance between tbe gun side end of each of the pair of opposite sides 60*a* and 62*a* and the apex of its convex target side end 68*a* is 24 millimeters. Each concave target side end 70*a* is curved with a radius of 20 millimeters. Each convex target side end 68*a* is curved with a radius of six millimeters.

The outer lens electrode 56*a* has a vertical dimension of 14 millimeters and a horizontal dimension, in the direction normal to the bulb axis, of 36 millimeters. The distance between the gun side end of each of the pair of opposite sides 80*a* and 82*a* and the apex of its convex target side end 86*a* is 33 millimeters. The distance between the gun side end of each of the other pair of opposite sides 76*a* and 78*a* and its straight target side end 84*a* is 29 millimeters. Each convex target side end 86*a* is curved with a radius of 46 millimeters. The aperture 138 in the end plate 136 has a vertical dimension of five millimeters and a horizontal dimension, as measured along the curvature of the target side ends 86*a*, of 30 millimeters. The spacings between the pair of opposite sides 60*a* and 62*a* of the inner lens electrode 54*a* and the pair of opposite sides 76*a* and 78*a* of the outer lens electrode 56*a* are each 5.5 millimeters, and the spacings between the pair of opposite sides 64*a* and 66*a* of the inner lens electrode and the pair of opposite sides 80*a* and 82*a* of the outer lens electrode are each 1.5 millimeters.

All but the apertured end plate 136 of the two lens electrodes 54*a* and 56*a* are fabricated of 0.5 millimeter thick nonmagnetic stainless steel plates. The end plate 136 is made of a 0.3 millimeter thick nonmagnetic stainless steel plate.

Operation of Second Form

Typical potentials that may be applied to the various electrodes of the CRT 1O*a* are as follows: −2000 volts to the gun cathode 38; from −2100 to −2000 volts to the first gun grid 40; 0 volt to the second gun grid 42; from −200 to +200 volts to the second gun anode 46; +12,000 volts to the postaccelerating electrode 58; 0 volt to the inner lens electrode 54*a*; and from −1300 to −1000 volts to the outer lens electrode 56*a*.

Figure 21:
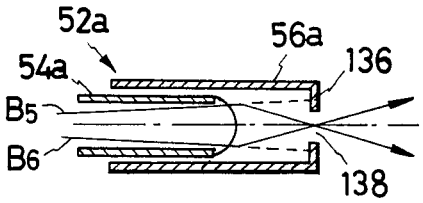
FIG. 21 is a schematic illustration of the deflection amplifying action of the lens system of FIG. 16 in a vertical direction.

Let it be assumed that the potential applied to the outer lens electrode 56*a* is −1200 volts, with the inner lens electrode 54*a* held at zero volt as above. FIG. 21 illustrates the consequent action of the scan expansion lens system 52*a* in the vertical direction. Deflected vertically by the deflection system 51, the electron beam indicated at B5 and B6 does not follow the dashed straight line paths but the solid line trajectories as its traveling directions are altered within the outer lens electrode 56*a*. Thus the beam passes the aperture 138 in the outer lens electrode end plate 136 and strikes the target 28.

Figure 22:
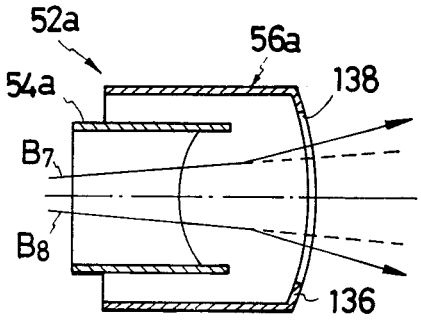
FIG. 22 is a similar illustration of the deflection amplifying action of the same lens system in a horizontal direction.

FIG. 22 likewise illustrates the deflection amplifying action of the lens system 52*a* in the horizontal direction. Deflected horizontally by the deflection system 51, the beam indicated at B7 and B8 also does not follow the dashed straight line paths but the solid line trajectories as its horizontal deflections are magnified, thus bombarding the target 28 after passing the aperture 138 in the outer lens electrode end plate 136. The above action of the lens system 52*a* is due to a kind of quadrupolar lens created by and between the curved ends 68*a* and 70*a* of the inner lens electrode 54*a* and the four sides 76*a* through 82*a* of the outer lens electrode 56*a*.

Figure 23:
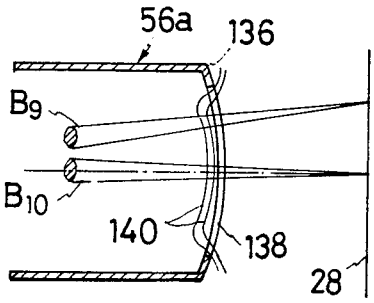
FIG. 23 is a similar illustration explanatory of the relationship between horizontal beam trajectories and the electron lens created adjacent the beam exit end of the lens system of FIG. 15.

The lens system 52*a* creates another lens in coaction with the postaccelerating electrode 58. Since a potential of 12.000 volts is now applied to the postaccelerating electrode 58, and that of −1200 volts to the outer lens electrode 56*a*, the field due to the postaccelerating electrode intrudes into the outer lens electrode through the aperture 138 in its end plate 136, thereby forming an electron lens which will hereinafter be referred to as the aperture lens. FIG. 23 shows at 140 the horizontal equipotentials of the aperture lens. As will be understood from this figure, the aperture lens hardly affects both horizontally deflected beam B9 and undeflected beam BIO, which are therefore focused on the target 28 anywhere in its horizontal direction.

Figure 24:
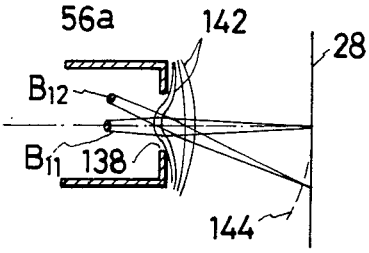
FIG. 24 is a similar illustration explanatory of the relationship between vertical beam trajectories and the electron lens created adjacent the beam exit end of the lens system of FIG. 15.

The vertical potential distribution of the aperture lens, on the other hand, is as represented by equipotentials 142 in FIG. 24. It will be observed that the equipotentials 142 bulge out into the end plate aperture 138 to provide a convergent lens. Thus, previously focused within the outer lens electrode 56*a*, the electron beam encounters the convergent aperture lens in the subsequent diverging state and is thereby focused on the screen 28. The converging action of the aperture lens is more intense on the beam B11 traveling along the axis of the lens system than on the beam B12 that has been deflected vertically. In the absence of this convergent aperture lens, the beam would focus along the dashed line 144 if the focusing voltage were so determined as to focus the beam centrally on the target 28. Any vertical deflection of the beam would then result in spot defocusing, as will be seen from the vertically deflected beam B12 in FIG. 24.

It may be pointed out in connection with the end plate aperture 138 of the outer lens electrode 56*a* that the curvature of this aperture, as viewed horizontally as in FIGS. 22 and 23, is a factor of some significance in the design of the lens system 52*a*. The electron beam on horizontal deflection has its deflection angle expanded, as in FIG. 22, between the inner 54*a* and outer 56*a* lens electrodes and then passes the arcuate end plate aperture 138 of the outer lens electrode. A change in the curvature of the aperture 138 (i.e. the curvature of the end plate 136) results in a change in the horizontal deflection factor. Thus the curvature of the end plate aperture 38 may be varied as desired to obtain a desired horizontal deflection factor or to control the linearity of the horizontal deflection factor of the lens created by and between the two lens electrodes 54*a* and 56*a*.

The design details of the lens system 52*a* should be determined in consideration of many structional and performance characteristics of the CRT in which it is to be incorporated, just as in the case of the first disclosed lens system 52. The dimensions of the two lens electrodes 54*a* and 56*a* depend mostly upon the axial length of the CRT, the quality area of its target screen, the desired vertical and horizontal deflection sensitivities, etc. Further the radii of curvature of the two pairs of opposite ends 68*a* and 70*a* of the inner lens electrode 54*a*, the radius of curvature of the pair of opposite ends 86*a* of the outer lens electrode 56*a*, and the distance between the gun side end of the outer lens electrode 56*a* and the farthest point on its curved target side end 86*a* may be determined so as to minimize image distortion on the target screen. A more extensive discussion on this subject follows.

The electron lens created by and between the two lens electrodes 54*a* and 56*a* definitely affects image distortion depending upon the curvatures of the two pairs of opposite ends 68*a* and 70*a* of the inner lens electrode 54*a*. If the radius of curvature of the pair of convex ends 68*a* of the inner lens electrode 54*a* is decreased from 6.0 millimeters to, say, 5.5 millimeters, vertical image lines will suffer barrel distortion, and horizontal image lines will suffer pincushion distortion. If the radius of curvature of the pair of concave ends 70*a* of the inner lens electrode 54*a* is decreased from 20 millimeters to, say, 17 millimeters, vertical image lines will suffer pincushion distortion, and horizontal image lines will suffer barrel distortion. Further a decrease in the radius of curvature of either of the two pairs of ends 68*a* and 70*a* of the inner lens electrode 54*a* results in intensifying the electron lens between the two lens electrodes 54*a* and 56*a*, thereby improving the deflection factor or sensitivity. Still further, if the radius of curvature of the pair of convex ends 68*a* of the inner lens electrode 54*a* is decreased, the lineality of horizontal deflection factor will become expansive. But this nonlinearity of the horizontal deflection factor can be compensated for by increasing the radius of curvature of the pair of convex ends 86*a* of the outer lens electrode 56*a* from 46 millimeters to, say, 50 millimeters.

As in the case of the first described lens system 52, the dimensions and geometries of the inner lens electrode 54*a* and those of the outer lens electrode 56*a* are interdependent. Consequently, as the dimensions and radii of curvature of the inner lens electrode 54*a* are determined as above, those of the outer lens electrode 56*a* as well as the size and position of its end plate aperture 138 are determined correspondingly.

This second modified lens system 52*a* is essentially similar in construction and operation to the lens system 52 except that the lens system 52*a* has the apertured end plate 136. The advantages of the lens system 52*a* are therefore the same as those of the lens system 52. The lens system 52*a* offers, moreover, a distinct advantage over that disclosed in the aforementioned Saito U.S. Pat. No. 4,302,704. The advantage is that the present invention allows the position where the vertically deflected beam has its traveling direction inverted within the lens system to come much closer to the end plate aperture 138 than does the prior art. This makes possible the substantial curtailment of the axial length of the lens system and, in consequence, of the CRT incorporating the same. Experiment has proved that, for a given accelerating voltage, tube length, and electron gun and deflection system configurations, the vertical and horizontal deflection factors of the CRT in accordance with the invention are 40 and 25 percent better, respectively, than those of the CRT in accordance with the above referenced U.S. patent.

Alternative Forms

Figure 25:
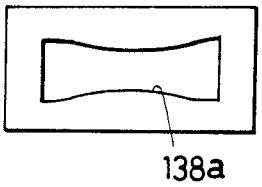
FIG. 25 is an elevation of a lens system having a modified end plate aperture.
Figure 26:
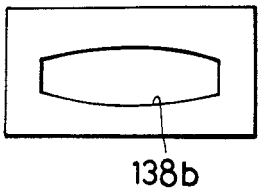
FIG. 26 is a similar view of a lens system having another modified end plate aperture.

The end plate aperture 138 of the second lens system 52*a* can be modified as at 138*a* and 138*b* in FIGS. 25 and 26 for the reduction of horizontal image line distortion or for the improved linearity of the horizontal deflection factor. The aperture 138*a* of FIG. 25 has its pair of opposite horizontal edges convexed toward each other. The aperture 138*b* of FIG. 26 has its pair of opposite horizontal edges concaved away from each other.

Figure 27:
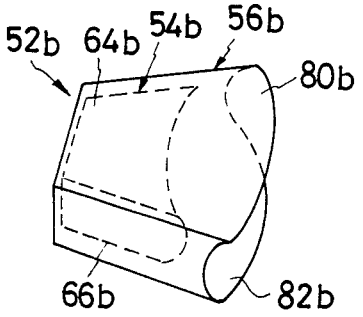
FIG. 27 is a perspective view of another modified lens system.

FIG. 27 shows a slight modification 52*b* of the lens system 52, in which the pair of opposite sides 64*b* and 66*b* of an inner electrode 54*b* and the pair of opposite sides 80*b* and 82*b* of an outer electrode 56*b* are each trapezoid shaped, increasing in width as they extend toward the target. The second described lens system 52*a* with its apertured end plate can be modified correspondingly.

Figure 28:
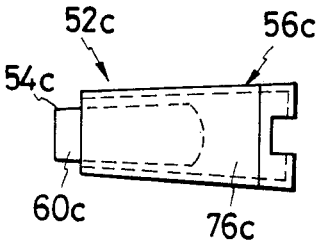
FIG. 28 is an elevation of still another modified lens system.

FIG. 28 sbows another modified lens system 52*c*, in which the pair of opposite sides 60*a* and 62*a* of the inner electrode 54*a*, and the pair of opposite sides 76*a* and 78*a* of the outer electrode 56*a*, of the second described lens system 52*a* are modified into trapezoidal shape, increasing in width as they extend towad the target. In FIG. 28, however, there are seen only one trapezoid shaped side 60*c* of the inner electrode 54*c*, and one trapezoid shaped side 76*c* of the outer electrode 56*c*, of the modified lens system 52*c*. The first described lens system 52 may be modifed correspondingly, although in this case the target side ends 84 of the outer electrode 56 must be concaved to a greater extent.

Figure 29:
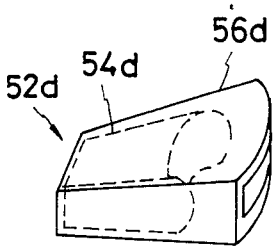
FIG. 29 is a perspective view of a further modified lens system.

The second described lens system 52*a* with the apertured end plate may further be modified as illustrated in FIG. 29. In this modified lens system 52*d* the four sides of the inner electrode 54*d* and the four sides of the outer electrode 56*d* are all trapezoid shaped, each increasing in width as it extends toward the target. The first described lens system 52 may likewise be modified, provided, however, that the target side ends 84 of the outer electrode 56 are concaved to a greater extent.

Figure 30:
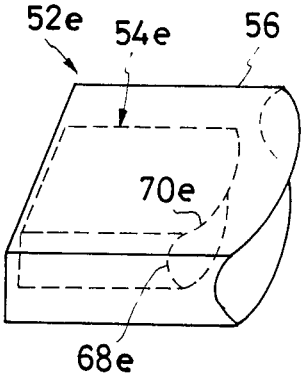
FIG. 30 is a perspective view of a further modified lens system.

In a further example of lens system 52*e* seen in FIG. 30, which is a modification of the first described lens system 52, the convexities and concavities of the two pairs of target side ends of the inner electrode 54*e* are reversed. Thus the pair of opposite target side ends 68*e* are concaved, and the other pair of opposite target side ends 70*e* are convexed. In the use of the thus modified lens system 52*e* a potential in the range from −1500 to −1200 volts may be applied to the inner electrode 54*e*, and a potential in the range from zero to +900 volts may be applied to the outer electrode 56.

Figure 31:
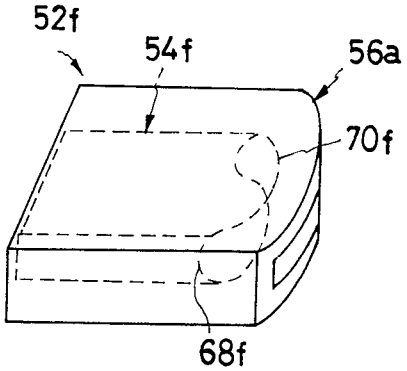
FIG. 31 is a perspective view of a further modified lens system.

The second described lens system 52*a* is shown similarly modified in FIG. 31 and therein generally designated 52*f*. The pair of opposite target side ends 68*f* of its inner electrode 54*f* are concaved, and the other pair of opposite target side ends 70*f* are convexed. In the use of the thus modified lens system 52*f* a potential in the range from +1500 to +2000 volts may be applied to the outer electrode 56*a*, and zero volt to the inner electrode 54*f*.

Figure 32:
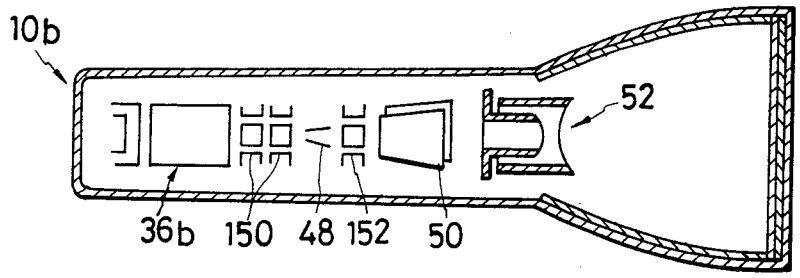
FIG. 32 is a longitudinal section through a further example of CRT to which the inventive concepts find application.
Figure 33:
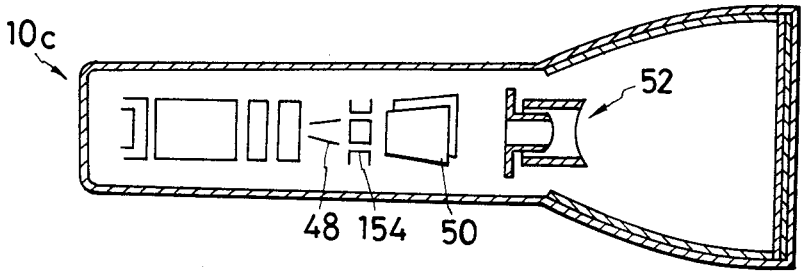
FIG. 33 is a longitudinal section through a further example of CRT to which the inventive concepts find application.

FIGS. 32 and 33 are explanatory of the fact that the various lens systems disclosed hereinbefore find applications in CRTs of other than FIGS. 1 and 15 configuration. The CRT 1O*b* of FIG. 32 has two quadrupolar lenses 150 incorporated in an electron gun 36*b*, and another quadrupolar lens 152 between vertical deflection plate pair 48 and horizontal deflection plate pair 50, for converging the electron beam. The CRT 1O*c* of FIG. 33 has but one quadrupolar lens 154 between vertical deflection plate pair 48 and horizontal deflection plate pair 50. Although FIGS. 32 and 33 show only the lens system 52 incorporated in the CRTs 1O*b* and 1O*c*, it is of course understood that the other lens systems (e.g. the lens system 52*a*) disclosed herein find use in these and other comparable CRTs.

Figure 34:
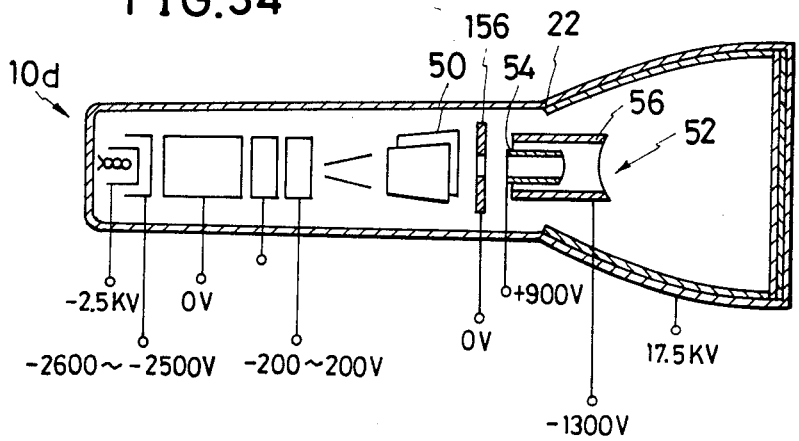
FIG. 34 is a longitudinal section through a further example of CRT to which the inventive concepts find application.
Figure 35:
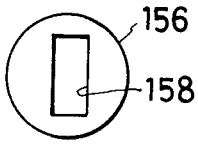
FIG. 35 is an elevation of the distortion correcting electrode in the CRT of FIG. 34.

In FIG. 34 is shown a further example of CRT 1O*d* in accordance with the invention, which features a distortion correcting electrode 156 interposed between horizontal deflection plate pair 50 and lens system 52. The distortion correcting electrode 156 is to coact with the beam entrance end portion of the inner electrode 54 of the lens system 52 to make up a quadrupolar lens in substitution for the mentioned lens constituted of the horizontal deflection plate pair 50 and the beam entrance end portion of the inner lens electrode 54. As better seen in FIG. 35, the distortion correcting electrode 156 is in the shape of a flat plate, herein shown as a disk, having formed therein a rectangular aperture 158 oriented vertically. The electrode 156 is so disposed in the CRT 1O*d* that the axis of its vacuum envelope 22 passes the geometrical center of the aperture 158. In the use of the CRT 1O*d* a potential of 0−+900 volts may be applied to the inner lens electrode 54, −1300 volts to the outer lens electrode 56, and zero volt to the distortion correcting electrode 156. The other lens systems disclosed herein could of course be used in place of the lens system 52 of this CRT 1O*d*.

Figure 36:
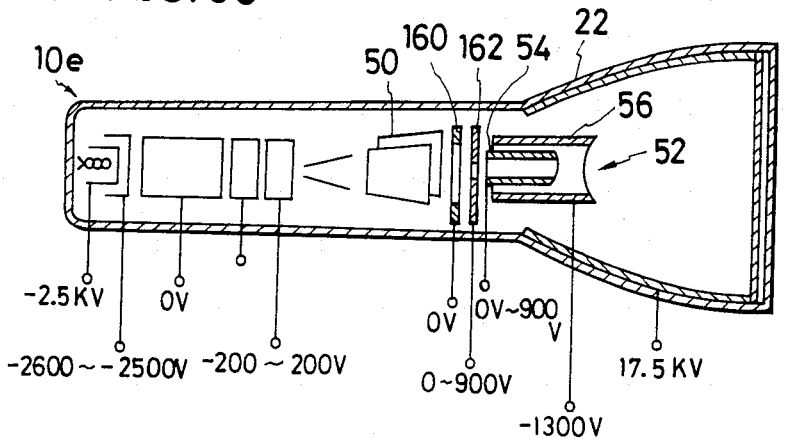
FIG. 36 is a longitudinal section through a further example of CRT to which the inventive concepts find application.
Figure 37:
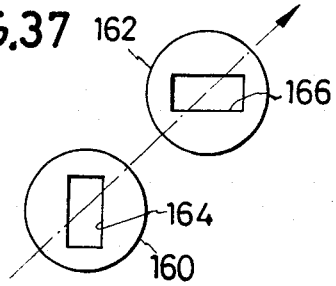
FIG. 37 is a schematic illustration explanatory of the relative angular positions of the two distortion correcting electrodes in the CRT of FIG. 36.

FIG. 36 shows a still further example of CRT 1O*e* in accordance with the invention, which features first 160 and second 162 distortion correcting electrode interposed in succession between horizontal deflection plate pair 50 and lens system 52. As better illustrated in FIG. 37, the two distortion correcting electrode 160 and 162 can also be in the shape of a disk or other flat plate. The first distortion correcting electrode 160 has a rectangular aperture 164 oriented vertically whereas the second distortion correcting electrode 162 has a rectangular aperture 166 oriented horizontally. The axis of the vacuum envelope 22 of the CRT 1O*e* passes the geometrical centers of the apertures 164 and 166. In the use of the CRT 1O*e* a potential of 0−+900 volts may be applied to the inner lens electrode 54, −1300 volts to the outer lens electrode 56, zero volt to the first distortion correcting electrode 160, and 0−+900 volts to the second distortion correcting electrode 162. Tbe other lens systems disclosed herein could of course be used in place of the lens system 52 of the CRT 1O*e*.

Figure 38:
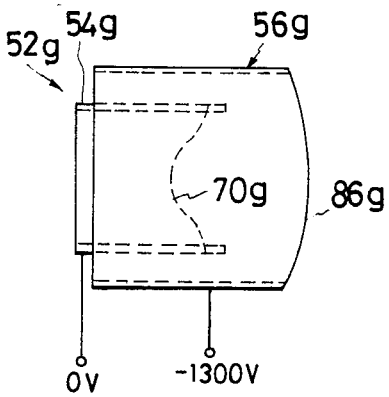
FIG. 38 is a plan view of a further modified lens system.
Figure 39:
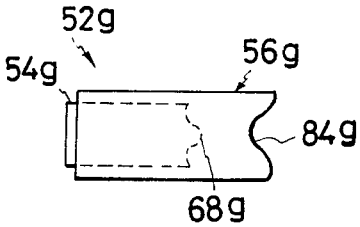
FIG. 39 is a side elevation of the lens system of FIG. 38.

Illustrated in FIGS. 38 and 39 is an additional example of lens system 52*g*. The target side ends 68*g* and 70*g* of the inner electrode 54*g*, and the target side ends 84*g* and 86*g* of the outer electrode 56*g*, of this lens system 52*g* are contoured to minimize image distortion on the target screen. This makes unnecessary the distortion correction by the electron lens composed of the inner lens electrode and the horizontal deflection plate pair or by the distortion correcting electrode 156 of FIGS. 34 and 35 or the distortion correcting electrodes 160 and 162 of FIGS. 36 and 37. The potentials applied to the inner electrode 54*g* and outer electrode 56*g* of this lens system 52*g* may be zero and −1300 volts, respectively.

Possible Modifications

Although the present invention has been shown and described hereinabove in terms of several embodiments and modifications thereof, it is understood that the invention itself is not to be limited thereto. Additional modifications or alterations will readily occur to one skilled in the art on the basis of this disclosure. The following is a brief list of such possible modifications:

1. The sides of the lens system may not be rectangular or trapezoidal in shape as in the illustrated embodiments but may have their corners rounded.

2. The pair of opposite target side ends 84 of the outer electrode 56 of the first described lens system 52 may be straight if this outer electrode is of very great width.

3. The pair of opposite target side ends 86 of the outer electrode 56 of the lens system 52 may also be straight in applications where high horizontal deflection sensitivity is not a requirement.

4. The pair of opposite target side ends 86*a* of the outer electrode 56*a* of the second described lens system 52*a* may also be straight.

5. The postaccelerating electrode is not the sole means for creating the electric field at and adjacent the target side end of the outer electrode of the lens system. Thus the invention finds an application to, for example, a storage tube having a collimation electrode as a postdeflection electrode.

What is claimed is:

1. In apparatus including a cathode ray tube having a target, an electron gun for emitting an electron beam directed toward the target deflection means disposed along the path of the beam from the gun to the target for deflecting the beam in two orthogonal directions, a scan expansion lens system disposed between the deflection means and the target for amplifying the deflections of the beam, and a postdeflection electrode disposed adjacent the lens system so that an electric field due to the postdeflection electrode acts at least upon a target side end portion of the lens system, the improvement wherein:

(a) the lens system comprises first and second tubular electrodes of substantially rectangular cross sectional shape disposed in axial alignment to allow the passage of the beam therethrough, each of the first and second electrodes having a beam entrance end directed toward the electron gun and a beam exit end directed toward the target, the second electrode enveloping at least a beam exit end portion of the first electrode with a gap sufficient to provide electrical insulation therebetween;

(b) the first electrode having a first pair of opposite sides oriented in one of the two orthogonal directions of beam deflection and a second pair of opposite sides oriented in the other of the orthogonal directions, the beam exit ends of the first pair of opposite sides being each curved in an arc that is convex in a first direction, the beam exit ends of the second pair of opposite sides being each curved in an arc that is convex in a second direction opposite to the first direction; and (c) the apparatus further includes means for applying such electrical potentials to the first and second electrodes of the lens system and to the postdeflection electrode that there are created:

(1) a first electron lens composed of the first and second electrodes for amplifying beam deflection in said one of the orthogonal directions by inverting within the second electrode the traveling direction of the beam that has been deflected in said one of the orthogonal directions by the deflection means, the first electron lens being further effective to amplify beam deflection in said other of the orthogonal directions by acting within the second electrode the beam that has been deflected in said other of the orthogonal directions by the deflection means; and (2) a second electron lens composed of the beam exit end portion of the second electrode and the postdeflection electrode, the second electron lens being located adjacent the beam exit end portion of the second electrode and acting to converge the beam in said one of the orthogonal directions.

2. The apparatus as recited in claim 1, wherein the second electrode of the lens system has a first pair of opposite sides oriented in said one of the orthogonal directions and a second pair of opposite sides oriented in said other of the orthogonal directions, the beam exit ends of the first pair of opposite sides of the second electrode being each curved in an arc that is convex in said second direction.

3. The apparatus as recited in claim 2, wherein the beam exit ends of the second pair of opposite sides of the second electrode of the lens system are each curved in an arc that is convex in said first direction.

4. The apparatus as recited in claim 1, further comprising a flange attached to the beam entrance end of the first electrode of the lens system for shielding the beam entrance end of the second electrode from the effects of the deflection means.

5. The apparatus as recited in claim 1, further comprising an end plate attached to the beam exit end of the second electrode of the lens system, the end plate having formed therein an aperture which is elongated in said other of the orthogonal directions.

6. The apparatus as recited in claim 5, wherein the second electrode of the lens system has a first pair of opposite sides oriented in said one of the orthogonal directions and a second pair of opposite sides oriented in said other of the orthogonal directions, the second pair of opposite sides of the second electrode being each curved in an arc that is convex in said first direction, and wherein the apertured end plate is convex in conformity with the curvature of the second pair of opposite sides of the second electrode.

7. The apparatus as recited in claim 5, wherein the aperture in the end plate is rectangular in shape.

8. The apparatus as recited in claim 5, wherein the aperture in the end plate is defined in part by a pair of opposite edges which extend in said other of the orthogonal directions and which are convexed toward each other.

9. The apparatus as recited in claim 5, wherein the aperture in the end plate is defined in part by a pair of opposite edges which extend in said other of the orthogonal directions and which are concaved away from each other.

10. The apparatus as recited in claim 1, wherein each of the first and second electrodes of the lens system is in the shape of a box.

11. The apparatus as recited in claim 1, wherein the second electrode of the lens system also has a first pair of opposite sides oriented in said one of the orthogonal directions and a second pair of opposite sides oriented in said other of the orthogonal directions, and wherein at least either of the first and second pairs of opposite sides of the first electrode and at least either of the first and second pairs of opposite sides of the second electrode gradually increase in width from the beam entrance end toward the beam exit end of the lens system.

12. The apparatus as recited in claim 1, further comprising distortion correcting means interposed between the deflection means and the lens system for correcting image distortion due to the lens system.

13. The apparatus as recited in claim 12, wherein the distortion correcting means comprises a distortion correcting electrode in the shape of a flat plate having formed therein a rectangular aperture extending in said one of the orthogonal directions.

14. The apparatus as recited in claim 12, wherein the distortion correcting means comprises a first distortion correcting electrode in the shape of a flat plate having formed therein a rectangular aperture extending in said one of the orthogonal directions, and a second distortion correcting electrode in the shape of a flat plate having formed therein a rectangular aperture extending in said other of the orthogonal directions, the first and second distortion correcting electrode being disposed one behind the other on the path of the electron beam from the deflection means to the lens system.

* * * * *

UNITED STATES PATENT AND TRADEMARK OFFICE

CERTIFICATE OF CORRECTION

PATENT NO. : 4,543,508

DATED : September 24, 1985

INVENTOR(S) : Kimiharu Saito

It is certified that error appears in the above-identified patent and that said Letters Patent is hereby corrected as shown below:

Column 8, line 61; deilection should read "deflection"

Column 11, lines 54 and 56; 10a should read "10a"

Column 12, lines 25 and 67; 10a should read "10a"

Column 12, line 32, tbe should read "the"

Column 13, line 32; 12.000 should read "12,000"

Column 13, line 42; B10 should read "B10"

Column 14, line 6; aperture 38 should read "aperture 138"

Column 15, line 32, sbows should read "shows"

Column 16, line 9; 10b should read "10b"

Column 16, line 13, 10c should read "10c"

Column 16, line 17, 10b and 10c should read "10b and 10c"

Column 16, line 21; 10d should read "10d"

Column 16, line 35, 10d should read "10d"

Column 16, line 37; 10d should read "10d"

UNITED STATES PATENT AND TRADEMARK OFFICE

CERTIFICATE OF CORRECTION

PATENT NO. : 4,543,508

DATED : September 24, 1985

INVENTOR(S) : Kimiharu Saito

It is certified that error appears in the above-identified patent and that said Letters Patent is hereby corrected as shown below:

Column 16, line 37; 0-+900 should read "0 - + 900"

Column 16, line 42, 10d should read "10d"

Column 16, line 43, 10e should read "10e"

Column 16, line 54; 10e should read "10e"

Column 16, line 56; 10e should read "10e"

Column 16, line 56; 0-+900 should read "0 - + 900"

Column 16, line 59; 0-+900 should read "0 - + 900"

Column 16, line 62; 10e should read "10e"

Signed and Sealed this

*Eighth* Day of *April 1986*

[SEAL]

*Attest:*

DONALD J. QUIGG

*Attesting Officer*

*Commissioner of Patents and Trademarks*